US007079090B2

(12) United States Patent
Takeuchi et al.

(10) Patent No.: US 7,079,090 B2
(45) Date of Patent: Jul. 18, 2006

(54) DRIVING METHOD FOR A PLASMA DISPLAY PANEL AND PLASMA DISPLAY APPARATUS

(75) Inventors: Masanori Takeuchi, Kawasaki (JP); Hideaki Ohki, Yokohama (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 290 days.

(21) Appl. No.: 10/294,592

(22) Filed: Nov. 15, 2002

(65) Prior Publication Data

US 2003/0151566 A1 Aug. 14, 2003

(30) Foreign Application Priority Data

Feb. 13, 2002 (JP) ..... 2002-035703

(51) Int. Cl.
*G09G 3/28* (2006.01)

(52) U.S. Cl. ..... 345/67; 345/60

(58) Field of Classification Search ..... 345/60–72; 315/169.1, 169.4; G09G 3/28
See application file for complete search history.

(56) References Cited

U.S. PATENT DOCUMENTS

| | | | | |
|---|---|---|---|---|
| 6,667,727 | B1 * | 12/2003 | Iwaoka | 345/60 |
| 2002/0008474 | A1 * | 1/2002 | Kurogi et al. | 313/584 |
| 2002/0039086 | A1 | 4/2002 | Hirakawa et al. | |
| 2002/0047592 | A1 * | 4/2002 | De Zwart et al. | 315/169.4 |
| 2003/0076049 | A1 * | 4/2003 | Kawada et al. | 315/169.4 |

FOREIGN PATENT DOCUMENTS

| | | | |
|---|---|---|---|
| CN | 1279560 | | 1/2001 |
| EP | 0 762 373 | A2 | 3/1997 |
| EP | 0762373 | | 3/1997 |
| EP | 11-272232 | | 10/1999 |
| EP | 1164561 | | 12/2001 |
| JP | 10-133621 | | 5/1998 |
| JP | 2000098971 | A * | 4/2000 |
| JP | 2001-13916 | | 1/2001 |
| JP | 2001228822 | A * | 8/2001 |
| JP | 2001345052 | A * | 12/2001 |
| JP | 2002-108279 | | 4/2002 |
| WO | WO 00/10154 | | 2/2000 |

OTHER PUBLICATIONS

Notice of the First Office Action.
Non-English language Chinese Office Action for CN1279560.
European Search Report dated Apr. 6, 2005 for European Patent Application No. EP 02 25 7967.

* cited by examiner

*Primary Examiner*—Alexander Eisen
(74) *Attorney, Agent, or Firm*—Staas & Halsey LLP

(57) ABSTRACT

A driving method and a PDP apparatus of a dot-matrix type PDP, in which a display of high-luminance and high-quality can be obtained when driven by the interlacing method, have been disclosed. In the driving method to drive, using the interlacing method, a dot matrix type AC plasma display panel comprising display electrodes that are arranged adjacently, extend in the same direction, and execute a light-emitting action in each display cell, and a rib that separates individual display cells, wherein a display line is formed between every pair of the display electrodes, the data in a line of the interlaced signal is displayed simultaneously in two neighboring lines and the centers of display are shifted in the odd field and the even field.

4 Claims, 12 Drawing Sheets

ODD FIELD

EVEN FIELD

ODD FIELD

EVEN FIELD

FIG.7

| ODD FIELD | EVEN FIELD |
|---|---|
| ① | ② |
| ① | ② |
| ③ | ④ |
| ③ | ④ |
| ⑤ | ⑥ |
| ⑤ | ⑥ |
| ⑦ | ⑧ |
| ⑦ | ⑧ |
| ⑨ | ⑩ |
| ⑨ | ⑩ |

FIG.8

| ODD FIELD | EVEN FIELD |
|---|---|
| ① | |
| ① | ② |
| ③ | ② |
| ③ | ④ |
| ⑤ | ④ |
| ⑤ | ⑥ |
| ⑦ | ⑥ |
| ⑦ | ⑧ |
| ⑨ | ⑧ |
| ⑨ | ⑩ |

ODD FIELD

EVEN FIELD

ODD FIELD

EVEN FIELD

FIG.14

| ODD FIELD | EVEN FIELD |
|---|---|
| ① | ② |
| ③ | ② |
| ③ | ④ |
| ⑤ | ④ |
| ⑤ | ⑥ |
| ⑦ | ⑥ |
| ⑦ | ⑧ |
| × | ⑧ |

DRIVING METHOD FOR A PLASMA DISPLAY PANEL AND PLASMA DISPLAY APPARATUS

BACKGROUND OF THE INVENTION

The present invention relates to a driving method for an ALIS method dot matrix type AC plasma display panel, comprising first electrodes and second electrodes that are arranged adjacently, extend in the same direction, and execute a light-emitting action in each display cell, and a rib that separates individual display cells, wherein a display line is formed between every pair of the first electrode and the neighboring second electrode. More particularly, the present invention relates to a driving method for an ALIS method dot matrix type AC plasma display panel, and a plasma display apparatus, that can achieve a display of high luminance and high quality.

A plasma display apparatus (PDP apparatus) has been put into practical use as a flat display and is expected to act as a thin display of high-luminance. In Japanese Patent No. 2001893, a PDP apparatus that employs the interlacing method that can realize a display of high resolution at a low cost has been disclosed. While a display line is formed between a pair of two neighboring display electrodes in a conventional PDP apparatus, the present PDP apparatus can double the number of the display lines when the number of the display electrodes is the same, or can realize the number of the display lines with half a number of the electrodes by forming a display line between every pair of a display electrode and its neighboring display electrode. This method is called the ALIS (Alternate Lighting of Surfaces) method.

FIG. 1 is a block diagram that shows the general structure of a conventional PDP apparatus that employs the ALIS method. A plasma display panel 1 comprises plural X electrodes (X1, X2, X3, . . . , X5) and Y electrodes (Y1, Y2, Y3, Y4) arranged adjacently, and plural address electrodes (A1, A2, A3, . . . , Am) arranged in the direction perpendicular to that of the X and Y electrodes, wherein phosphors are arranged at the crossings of the electrodes and a discharge gas is sealed in between the two substrates. An address electrode drive circuit 2 applies an address pulse to the address electrode, a scan electrode drive circuit 3 applies a sustain discharge (sustain) pulse as well as applying sequentially a scan pulse to the Y electrode, a sustain electrode drive circuit 4 applies a sustain discharge (sustain) pulse to the X electrode, and a control circuit 5 controls each part. Since the detailed structure and operations of the PDP apparatus that employs the ALIS method have been disclosed in Japanese Patent No. 2001893, a more detailed description is not given here.

FIG. 2 is a diagram that shows the display lines in a normal type PDP apparatus that employs the ALIS method. As described above, in the PDP apparatus that employs the ALIS method, a display is achieved by the interlacing method used widely in such as a TV receiver, wherein odd-numbered display lines 1, 3, 5, . . . are displayed in the odd field and even-numbered display lines 2, 4, 6, . . . are displayed in the even field. In other words, (2N−1) (N is an integer equal to or greater than 1) display lines are displayed in the odd field and the 2N (N is an integer equal to or greater than 1) display lines are displayed in the even field. In order to obtain 2N display lines in a PDP apparatus that employs the ALIS method, (2N+1) X electrodes and 2N Y electrodes are formed. As the X electrode and the Y electrode have an identical shape and light emission for display is executed by a sustain discharge between them, the X electrodes and the Y electrodes are called the display electrodes here.

The normal plasma display panel (PDP) that employs the ALIS method is equipped with a rib between the address electrodes in parallel thereto so that light emission in the lit cell does not propagate to the neighboring cells in the direction in which the display electrode extends. It is, however, designed so that discharge is prevented from propagating in the direction in which the address electrode extends by suppressing the difference in voltage between the display electrodes (X electrodes and Y electrodes) in the unlit rows rather than by providing a rib between display electrodes.

FIG. 3A and FIG. 3B show the state of discharge in the normal PDP apparatus that employs the ALIS method. As shown in FIG. 3A, a discharge is caused to occur to emit light between a Y electrode and the X electrode located above by one in the odd field, and as shown in FIG. 3B, a discharge is caused to occur to emit light between a Y electrode and the X electrode located below by one in the even field. As described above, the discharge will propagate beyond the electrode to the neighboring display row (unlit row) because no rib is provided between the display electrodes.

However, the ALIS method PDP apparatus that does not have a rib between the display electrodes, as described above, prevents discharge from propagating in the direction in which the address electrode extends by preventing a large voltage from being applied between the display electrodes in unlit rows, therefore, a problem is caused that circuits are difficult to design and light emission efficiency is low because it is impossible to increase the driven electrode applied voltage to be applied between the display electrodes.

The present applicants, therefore, have disclosed the ALIS method dot matrix type AC plasma display panel (PDP) and the PDP apparatus in which individual display cells are separated by providing the grid-shaped rib in Japanese Patent Application No. 2000-304404. FIG. 4 is a diagram that shows the cell structure of a dot matrix type PDP. As shown schematically, plural display electrodes composed of a transparent electrode 12 and an opaque metal electrode 13 are arranged at equal intervals on a glass substrate 11 and a dielectric layer 14 and a protective film 15 are provided thereon. On the other glass substrate 19, plural address electrodes A are arranged, a dielectric layer 17 is formed thereon, and moreover, a grid-shaped rib 16 is formed. Each part of the grid-shaped rib 16 corresponds to a mid line between the address electrodes A and the metal electrode 13. On the dielectric layer 17 that is defined by the rib 16, phosphors 18R, 18G, and 18B of three colors R, G, and B, respectively, are formed. The glass substrates 11 and 19 are bonded to each other and a discharge gas is sealed in therebetween.

FIG. 5 is a diagram that shows the pattern of the rib of the dot matrix type PDP with the structure shown in FIG. 4. As shown schematically, the rib 16 has a grid shape, each part of which is located on a mid line between the address electrodes A and the metal electrode 13. Each part defined by the rib 16 corresponds to each display cell. It is similar to the ALIS method PDP in that one display electrode is shared by two neighboring display lines.

The dot matrix type PDP has advantages in that the circuit design is simple and the light emission efficiency is high because discharge is prevented from propagating beyond the range of each display cell defined by the rib, therefore, the driven electrode applied voltage to be applied between the display electrodes can be increased. Moreover, it is possible for the dot matrix type PDP to execute a display not only by the interlacing method but also by the progressive method in which every display row is displayed simultaneously. On the other hand, in order to form 2N display lines, all that is required is to provide (2N+1) display electrodes, as in the case of the conventional ALIS method.

FIG. 6A and FIG. 6B are diagrams that show the state of discharge when the dot matrix type PDP is driven by the interlacing method. As shown in FIG. 6A, odd-numbered display lines are displayed in the odd field and even-numbered display lines are displayed in the even field as shown in FIG. 6B. As obvious from the figure, the discharge range does not increase because it is defined by the ribs and the range of light emission becomes small. Because of this, a problem occurs that luminance is lowered, compared to the case where the conventional ALIS method PDP shown in FIG. 3A and FIG. 3B is driven by the interlacing method.

Japanese unexamined Patent Publication (Kokai) No. 10-133621 has disclosed a technique that can perform the non-interlaced display instead of the interlaced display by writing data of a line simultaneously into two lines when interlaced signals are displayed because there is no display information in non-display rows in each of the odd-numbered and even-numbered fields. If this technique is applied to drive a dot matrix type PDP, luminance can be raised because the display area is extended substantially. When the technique disclosed in Japanese Unexamined Patent Publication (Kokai) No. 10-133621 is applied to drive a dot matrix type PDP, it is easy to write the same data into the both display cells on both sides of a Y electrode by keeping an identical voltage being applied to the X electrodes on both sides of the Y electrode (scan electrode). As a result, the same display data is displayed in the two display lines on both sides of each Y electrode both in the odd field and in the even field.

FIG. 7 is a diagram that shows the display lines when the technique disclosed in Japanese Unexamined Patent Publication (Kokai) No. 10-133621 is applied to drive a dot matrix type PDP. In the odd field, the (2N−1) th data is displayed in the (2N−1) th and the 2N th display lines, and the 2N th data is displayed in the (2N−1) th and 2N th display lines in the even field. In other words, both the (2N−1) th data and the 2N th data are displayed in the same position.

The (2N−1) th data and the 2N th data, however, should be displayed, being shifted by one row from each other, and if displayed being shifted, the frame resolution is not degraded but if displayed as shown in FIG. 7, the centers of display that display different information coincide in the odd field and in the even field, and a problem is caused that the frame resolution is degraded by half.

SUMMARY OF THE INVENTION

The objective of the present invention is to realize a driving method and a PDP apparatus of a dot matrix type PDP by which a display of high-luminance and high-quality can be obtained even if driven by the interlacing method.

In order to realize the above-mentioned objective, in the driving method and the PDP apparatus of a dot matrix type PDP of the present invention, the data of a line of the interlaced signal is displayed simultaneously in two lines and the centers of display of the two lines are shifted in the odd field and in the even field to improve luminance.

FIG. 8 is a diagram that shows the display lines of the present invention. In the odd field, the data in the (2N−1) th row (N is an integer equal to or greater than 1) is displayed both in the (2N−1) th row and in the 2N th row, and the data in the 2N th row is displayed both in the 2N th row and in the (2N+1) th row in the even field. As a result, the data in the (2N−1) th row and that in the 2N th row are displayed with the centers of display being shifted by one row, and the resolution can be prevented from being degraded. In FIG. 8, the number of the display lines is even, and each data in the odd-numbered rows is displayed in two rows in the odd field, the first display row is not displayed and the data in the last even-numbered row is displayed only in the last row in the even field, but it is also possible to shift the display rows in FIG. 8 so that each data in the even-numbered rows is displayed in two rows in the even field, the data in the first row is displayed only in one row and the last display row is not displayed in the odd field.

In order to apply the present invention to a dot matrix type PDP, it is necessary to switch the display electrodes to be used as scan electrodes in the odd field and the even field between odd-numbered ones and even-numbered ones or between even-numbered ones and odd-numbered ones. For example, if odd-numbered display electrodes are used as first electrodes and even-numbered display electrodes, as second display electrodes, either the first or the second display electrodes are used as scan electrodes in the odd field, and in the even field, the other display electrodes are used as scan electrodes.

In order to switch the scan electrodes between the odd field and the even field, as described above, it is necessary to provide a scan electrode switch that switches a scan electrode drive circuit, which puts out scan pulses sequentially during addressing and simultaneously puts out sustain discharge pulses during sustain discharge, so that it is alternately connected to the first and the second display electrodes, and a sustain electrode switch that switches a sustain electrode drive circuit, which puts out sustain discharge pulses during sustain discharge, so that it is alternately connected to the first and the second display electrodes, to which the scan electrode drive circuit is not connected.

In another aspect, two scan electrode drive circuits that put out scan pulses sequentially during addressing and simultaneously put out sustain discharge pulses during sustain discharge are provided and the first display electrodes are driven by one of them and the second display electrodes are driven by the other.

BRIEF DESCRIPTION OF THE DRAWINGS

The features and advantages of the invention will be more clearly understood from the following description taken in conjunction with the accompanying drawings, in which

FIG. 7 is a diagram that shows the display lines when two lines are written and displayed simultaneously in a dot matrix type PDP.

FIG. 8 is a diagram that shows the display lines of the present invention.

FIG. 14 is a diagram that shows the display lines in the second embodiment.

DESCRIPTION OF THE PREFERRED EMBODIMENTS

Figure 1:
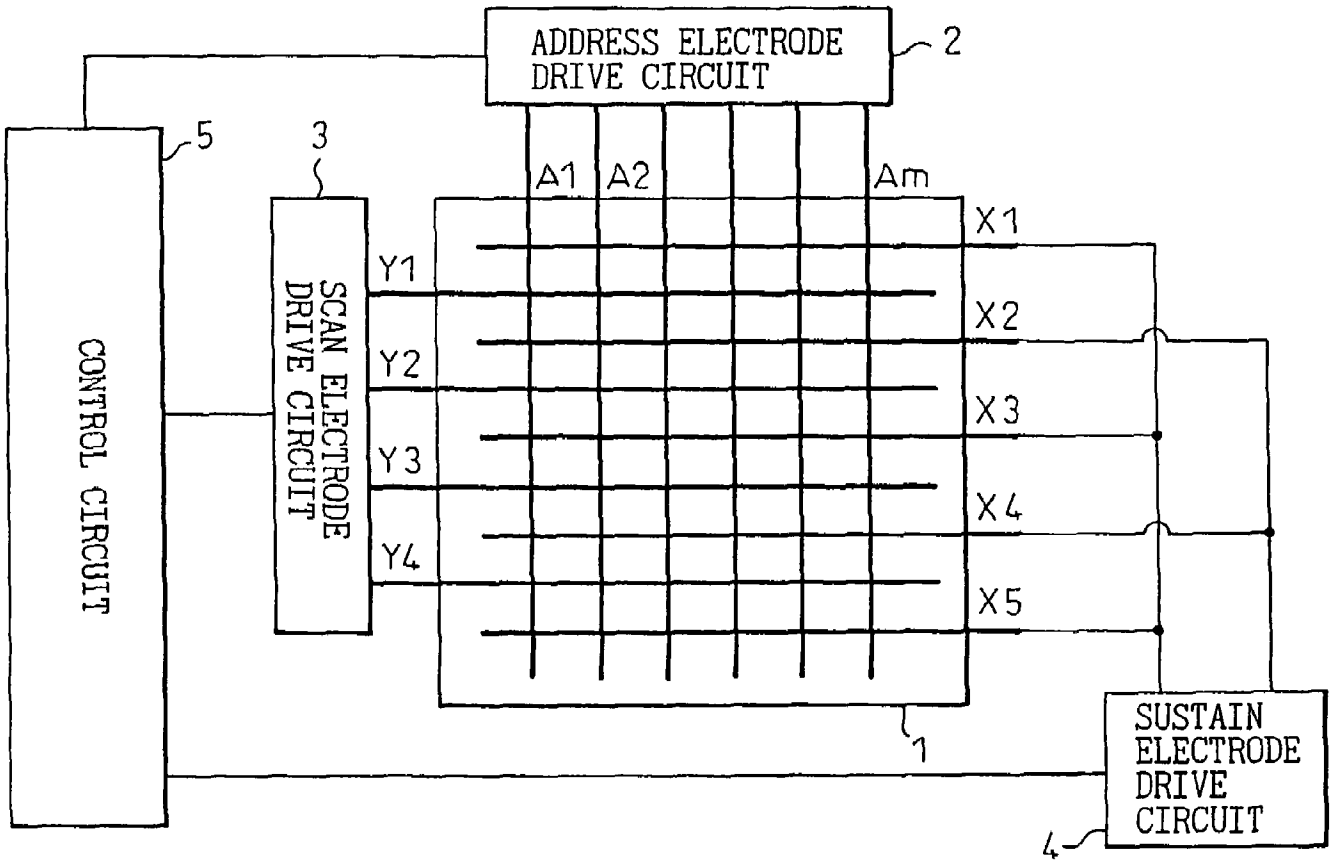
FIG. 1 (PRIOR ART)
FIG. 1 is a block diagram that shows the rough structure of a conventional ALIS method PDP apparatus.
Figure 2:
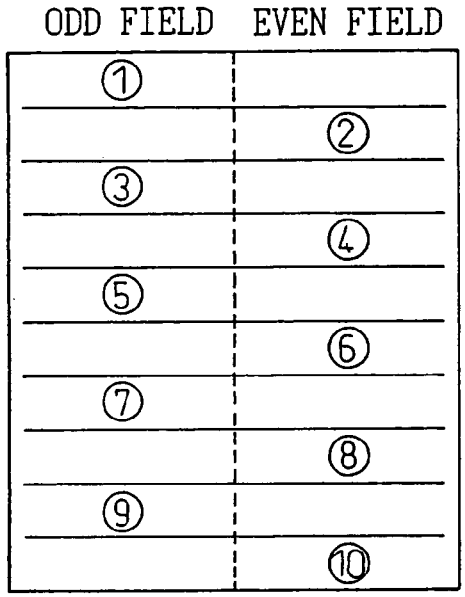
(PRIOR ART) FIG. 2
FIG. 2 is a diagram that shows the display lines of a normal ALIS method PDP apparatus.
Figure 3A:
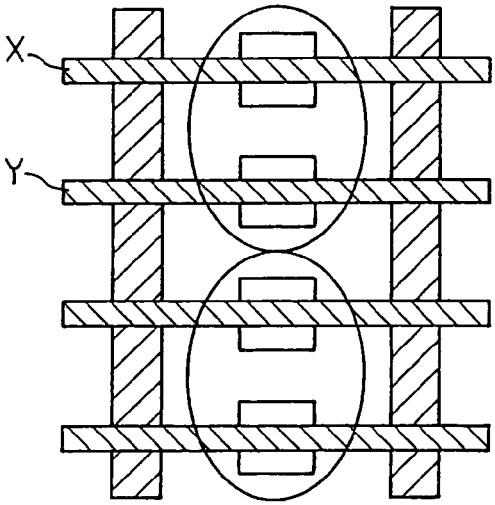
(PRIOR ART) FIG. 3A
FIG. 3A and FIG. 3B are diagrams that show the states of discharge in the display cells of a normal ALIS method PDP apparatus.
Figure 3B:
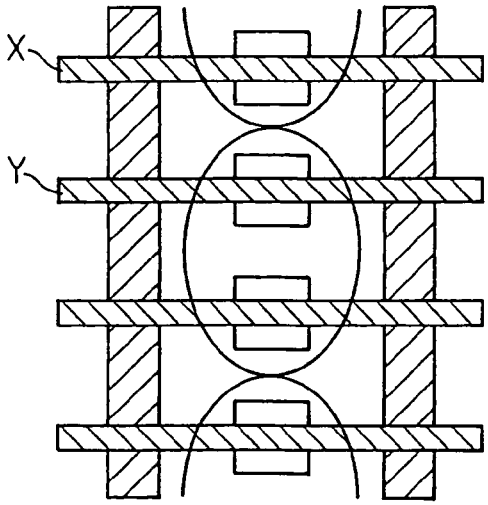
(PRIOR ART) FIG. 3B
Figure 4:
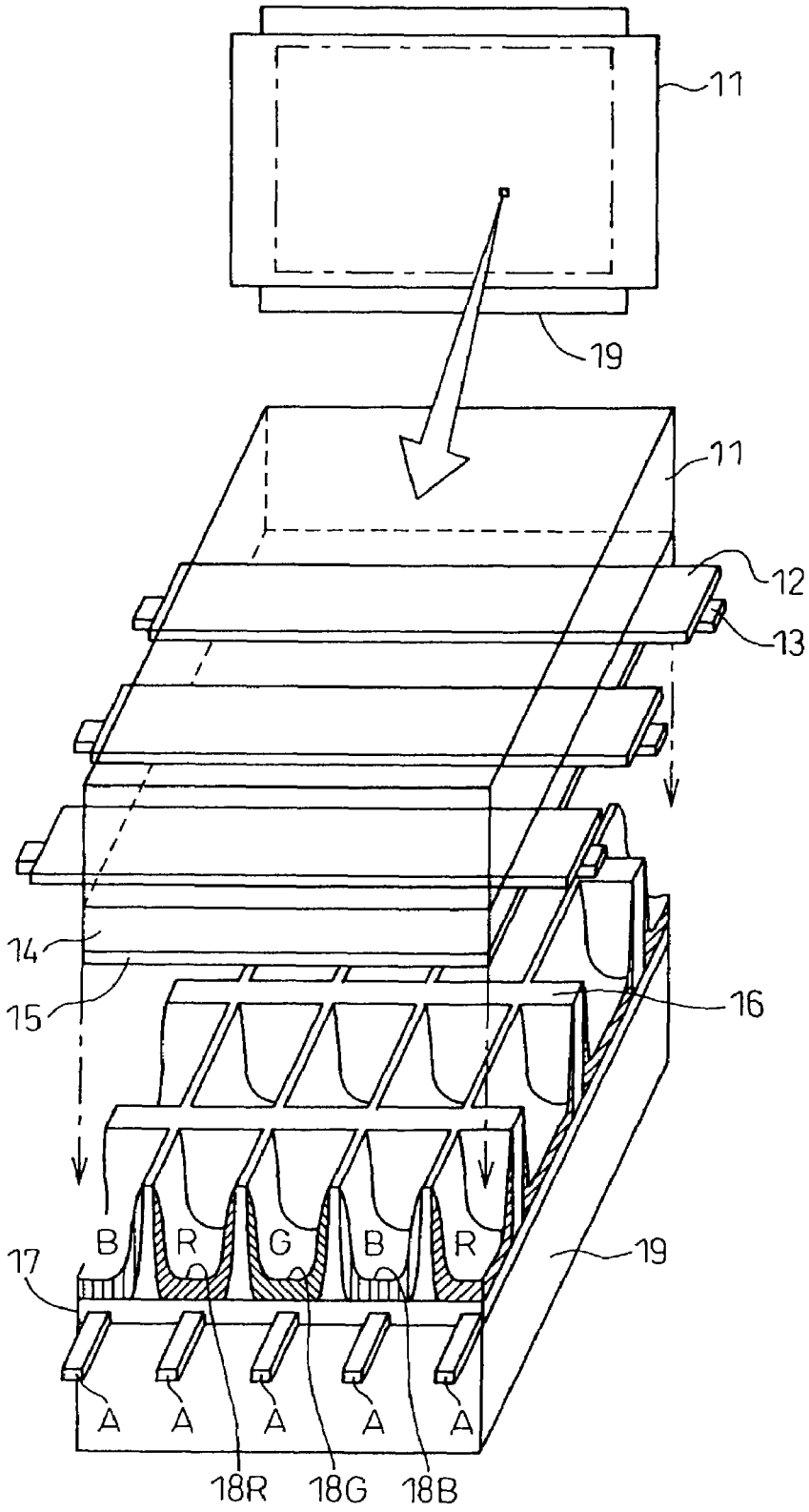
FIG. 4 is a diagram that shows the cell structure of a dot matrix type PDP.
Figure 5:
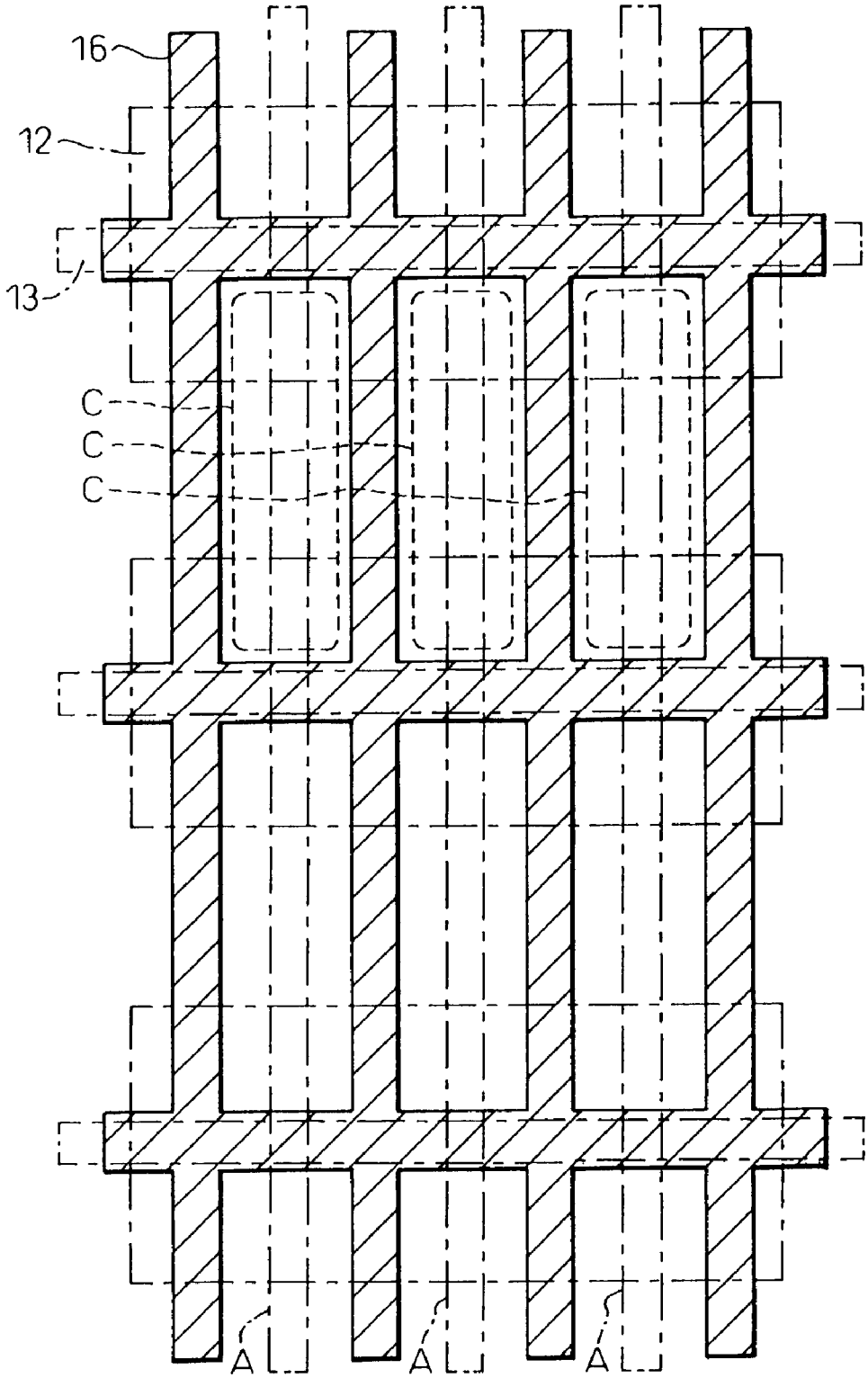
FIG. 5 is a diagram that shows the rib pattern of a dot matrix type PDP.
Figure 6A:
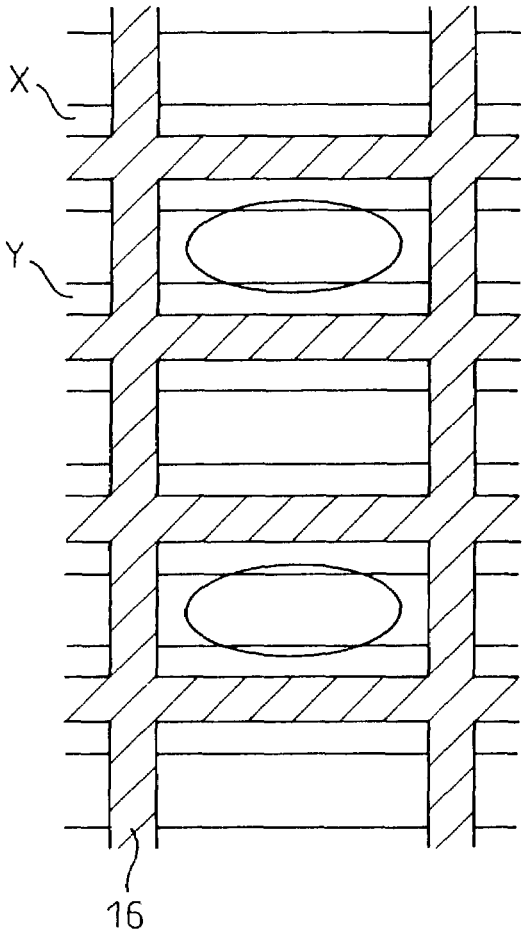
FIG. 6A and FIG. 6B are diagrams that show the states of discharge when a dot matrix type PDP is driven by the interlacing method.
Figure 6B:
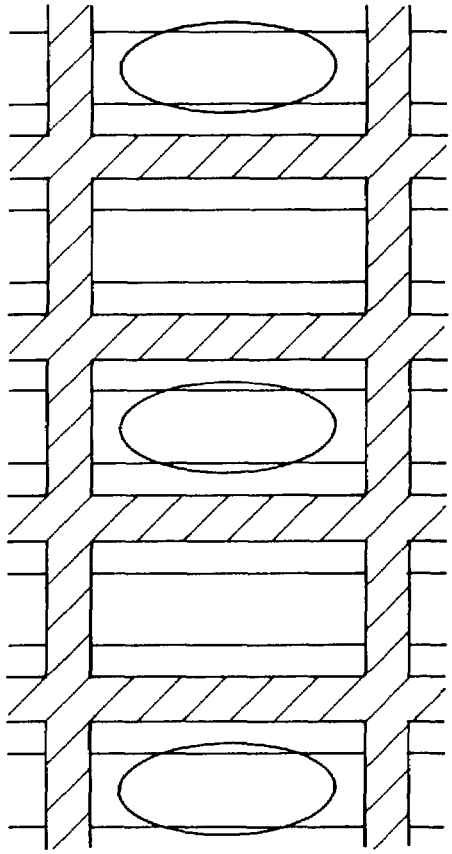
Figure 9:
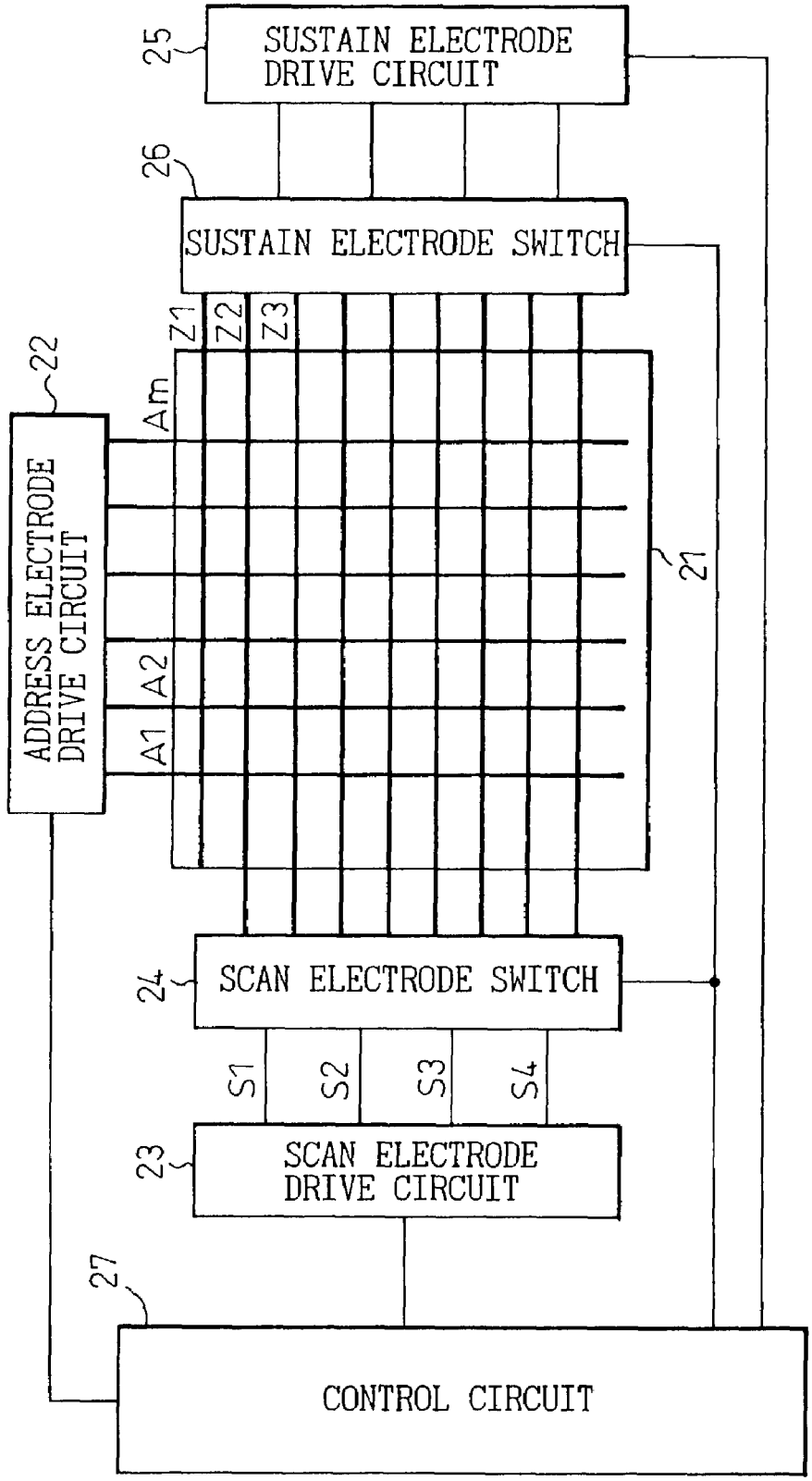
FIG. 9 is a block diagram that shows the rough structure of the PDP apparatus in the first embodiment of the present invention.

FIG. 9 is a block diagram that shows the rough structure of the PDP apparatus in the first embodiment of the present invention. A plasma display panel (PDP) 21 is a dot matrix type PDP that has the structure shown in FIG. 4. Among display electrodes Z1, Z2, . . . , the odd-numbered display electrodes are called the first display electrodes and the even-numbered display electrodes are called the second display electrodes. An address electrode drive circuit 22 that drives address electrodes A is the same as that used in the conventional ALIS method PDP apparatus shown in FIG. 1, and a scan electrode drive circuit 23 and a sustain electrode drive circuit 25 are the same as those used in the conventional ALIS method PDP apparatus shown in FIG. 1. The PDP apparatus in the first embodiment comprises a scan electrode switch 24 and a sustain electrode switch 26 and differs from the conventional one in that a control circuit 27 writes identical data simultaneously into the two neighboring lines to control the display of all the display lines and, at the same time, it controls the scan electrode switch 24 and the sustain electrode switch 26.

Figure 10A:
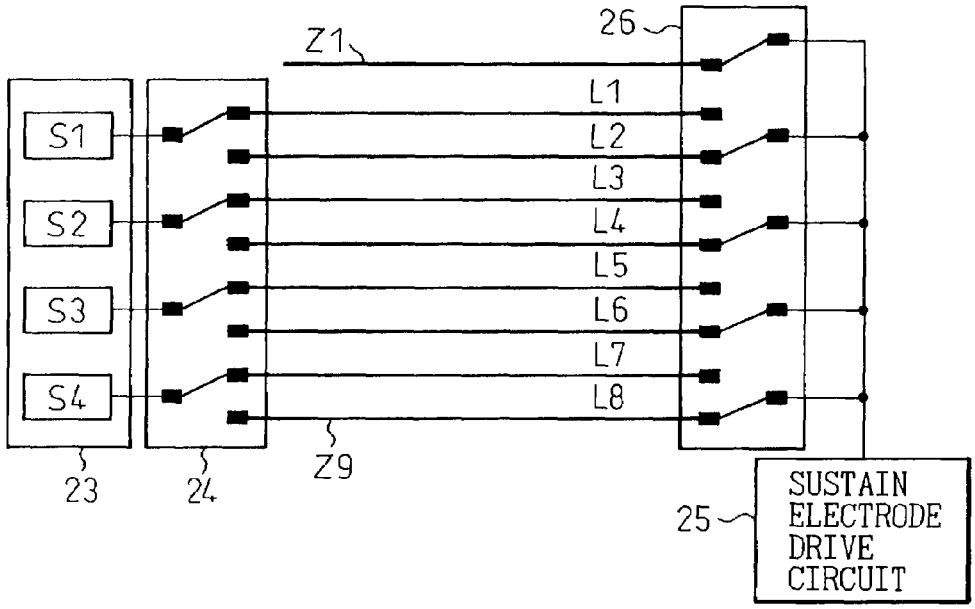
FIG. 10A and FIG. 10B are diagrams that show the switch operations in the first embodiment.
Figure 10B:
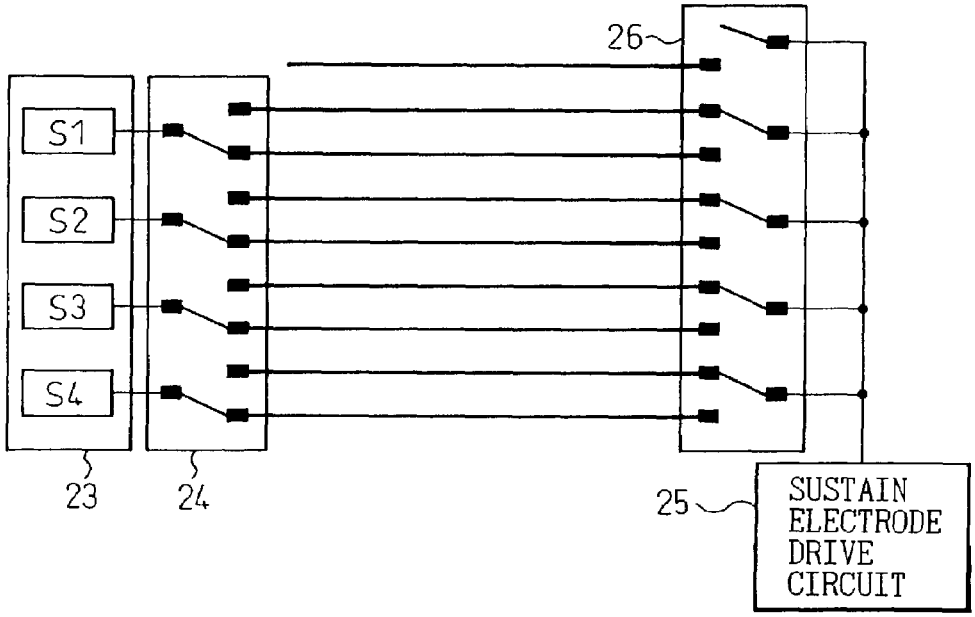

FIG. 10A and FIG. 10B are diagrams that show the states of connection of the scan electrode switch 24 and the sustain electrode switch 26, wherein FIG. 10A shows the state of connection in the odd field and FIG. 10B shows that in the even field. As shown in 10A, in the odd field, the scan electrode switch 24 connects the second display electrodes (even-numbered display electrodes) Z2, Z4, . . . , to the scan electrode drive circuit 23 and the sustain electrode switch 26 connects the first display electrodes (odd-numbered display electrodes) Z1, Z3, . . . , to the sustain electrode drive circuit 25. As shown in 10B, in the even field, the scan electrode switch 24 connects the first display electrodes Z3, Z5, . . . , excluding the first one, to the scan electrode drive circuit 23 and the sustain electrode switch 26 connects the second display electrodes Z2, Z4, . . . , to the sustain electrode drive circuit 25.

Figure 11:
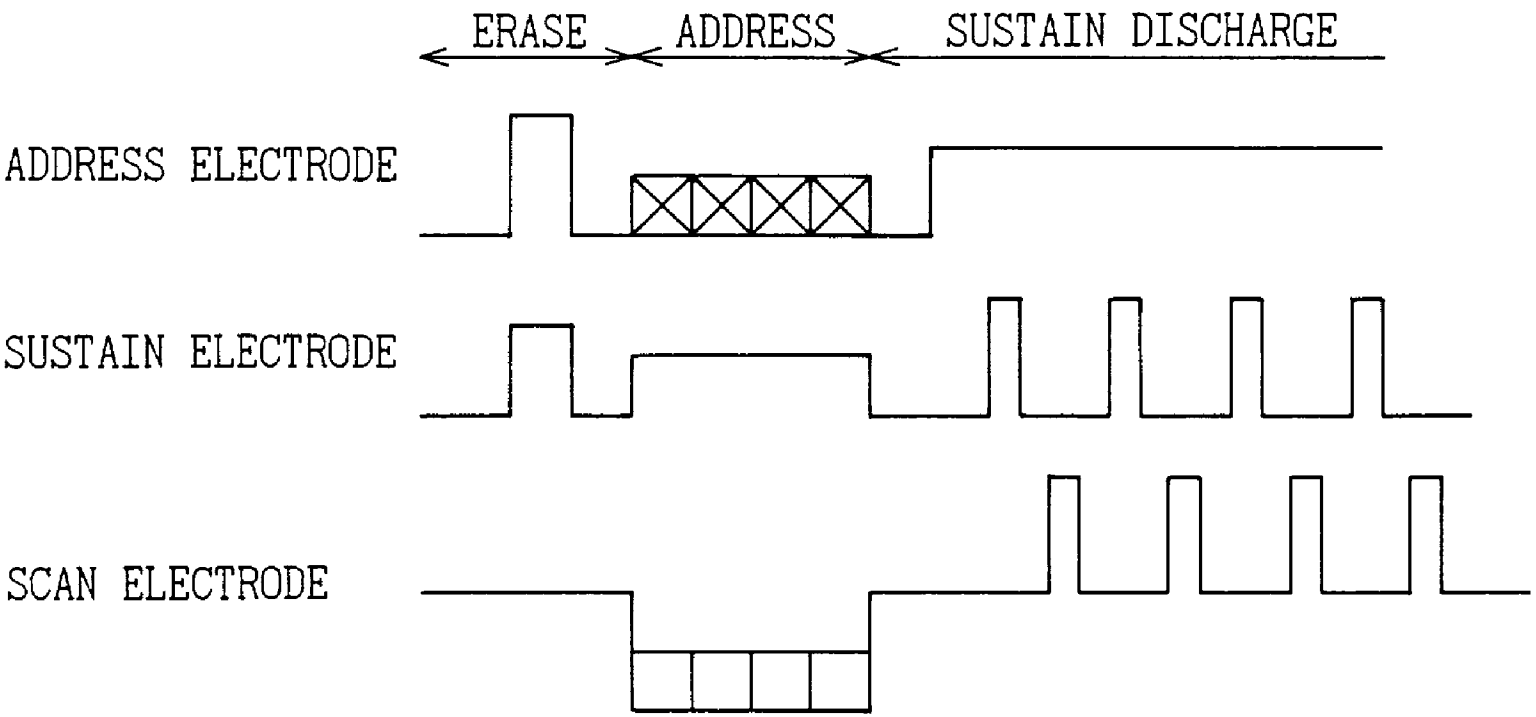
FIG. 11 is a diagram that shows the drive waveforms in the first embodiment.

FIG. 11 is a diagram that shows the drive waveforms of the PDP apparatus in the first embodiment, and the drive waveforms are the same both in the odd field and in the even field. The scan electrode switch 24 and the sustain electrode switch 26, however, are in the states of connection as shown in FIG. 10A and FIG. 10B in the odd field and the even field. The display electrodes, to which the scan pulses supplied from the scan electrode drive circuit 23 through the scan electrode switch 24 are applied, are referred to as the scan electrodes and other display electrodes are referred to as the sustain electrodes here. In the erase period, with 0 V being applied to the scan electrode, positive pulses of a large voltage are applied to the address electrodes and positive pulses of a comparatively small voltage are applied to the sustain electrodes to cause an erase discharge to occur in all the display cells to bring all the display cells into a uniform state.

In the address period, with a comparatively small positive voltage being applied to the sustain electrode, a negative voltage is applied to the scan electrode and a scan pulse of a negative voltage is applied sequentially in such a manner as to overlap each other. In synchronization with the application of the scan pulse, a data voltage is applied to the address electrode. The data voltage is a positive one if a display cell to be lit, and 0V, if a display cell not to be lit. In a cell to be lit, the voltage between the scan electrode and the address electrode exceeds the discharge start voltage to cause an address discharge to occur, and wall charges are accumulated on the dielectric layer on the scan electrode and the sustain electrode. In a cell not to be lit, no wall charge is accumulated because no discharge is caused to occur. In the dot matrix type PDP in the present embodiment, the display electrode is common to the neighboring display lines, and an address discharge is caused to occur simultaneously in the display cells on both sides of a scan electrode. In other words, write action is carried out simultaneously in two display lines. Moreover, as the individual display cells are defined by the rib, it is unlikely that an address discharge affects the neighboring display cells to induce a discharge.

In the odd field, as described above, the scan electrode switch 24 connects the second display electrodes (even-numbered display electrodes) Z2, Z4, . . . to the scan electrode drive circuit 23 and the sustain electrode switch 26 connects the first display electrodes (odd-numbered display electrodes) Z1, Z3, . . . to the sustain electrode drive circuit 25. In the odd field, therefore, the scan pulse is applied sequentially to the second display electrodes Z2, Z4, . . . , the data in the first row is written into the display lines L3 and L2 in the first and second rows, and the data in the third row is written into the display lines L3 and L4 in the third and fourth rows. In the even field, the scan electrode switch 24 connects the display electrodes Z3, Z5, . . . , excluding the first one, to the scan electrode drive circuit 23 and the sustain electrode switch 26 connects the second display electrodes Z2, Z4, . . . to the sustain electrode drive circuit 25. In the odd field, therefore, the scan pulse is applied sequentially to the first display electrodes Z3, Z5, . . . , the data in the second row is written into the display lines L2 and L3 in the second and third rows, and the data in the fourth row is written into the display lines L4 and L5 in the fourth and fifth rows. No data is written into the display line L1 and the last data is written only into the last display line.

In the sustain discharge period, with a positive voltage being applied to the address electrode, the sustain pulse is applied alternately to the sustain electrode and the scan electrode. Due to this, in a display cell in which an address discharge has been caused to occur and wall charges have been accumulated, the voltage due to the wall charges overlaps the sustain pulse, the discharge start voltage is exceeded, and the sustain discharge is caused to occur. The sustain discharge continues as long as the sustain pulse is being applied. As for the sustain discharge also, it is unlikely that the sustain discharge affects the neighboring display cells to induce a discharge because individual display cells are separated by the rib. As the data has been written in the address period, as described above, the display as shown in FIG. 8 is executed.

Figure 12:
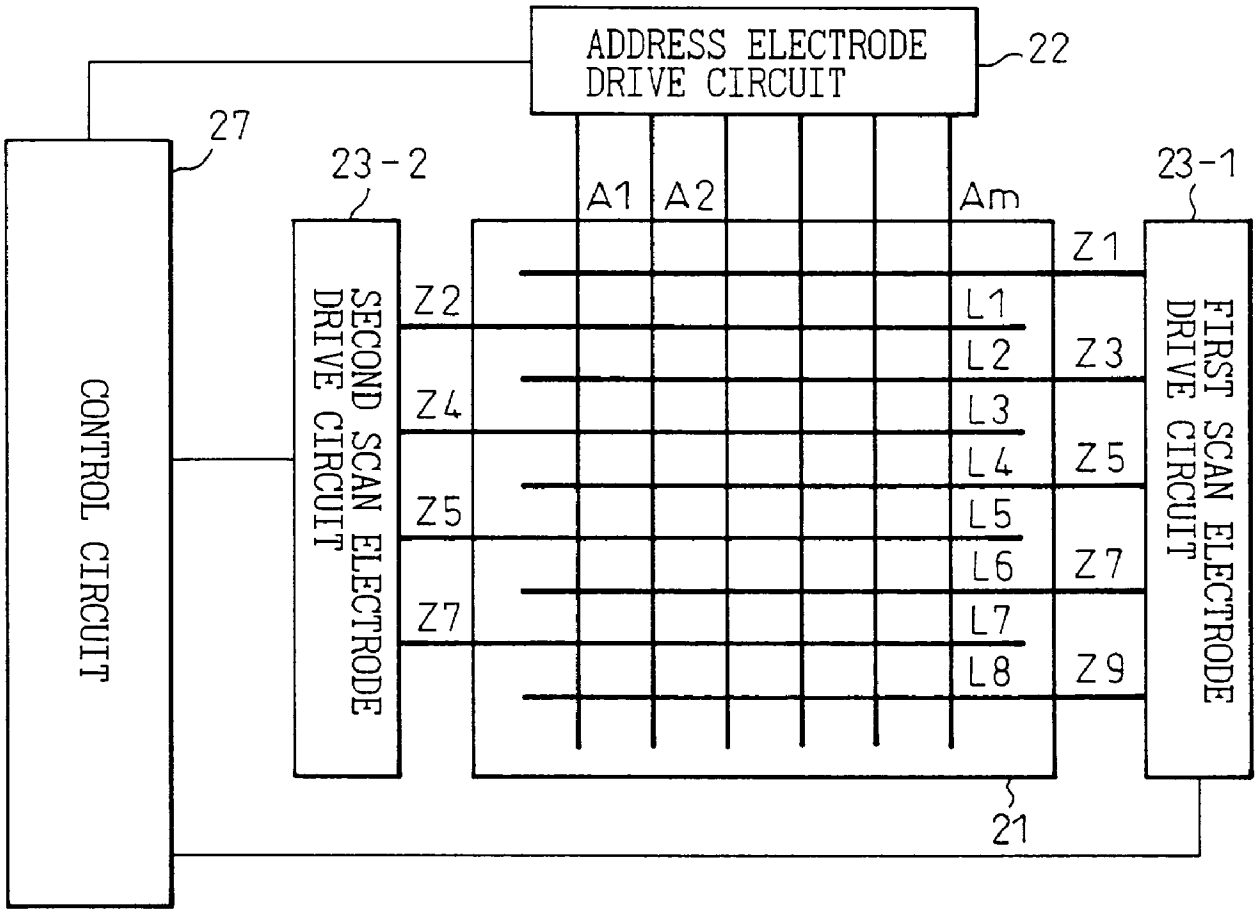
FIG. 12 is a block diagram that shows the rough structure of the PDP apparatus in the second embodiment of the present invention.

FIG. 12 is a block diagram that shows the general structure of the PDP apparatus in the second embodiment of the present invention. The plasma display panel (PDP) 21 is the dot matrix type PDP, similarly to the first embodiment and the address electrode drive circuit 22 that drives the address electrode is also the same as that in the first embodiment. Among the display electrodes, the odd-numbered display electrodes Z1, Z3, . . . are used as the first display electrodes and the even-numbered display electrodes Z2, Z4, . . . are used as the second display electrodes. In the second embodiment, two scan electrode drive circuits are used, wherein a first scan electrode drive circuit 23-1 drives the first display electrodes Z1, Z3, . . . , and a second scan electrode drive circuit 23-2 drives the second display electrodes Z2, Z4, . . . The control circuit 27 controls each part.

Figure 13A:
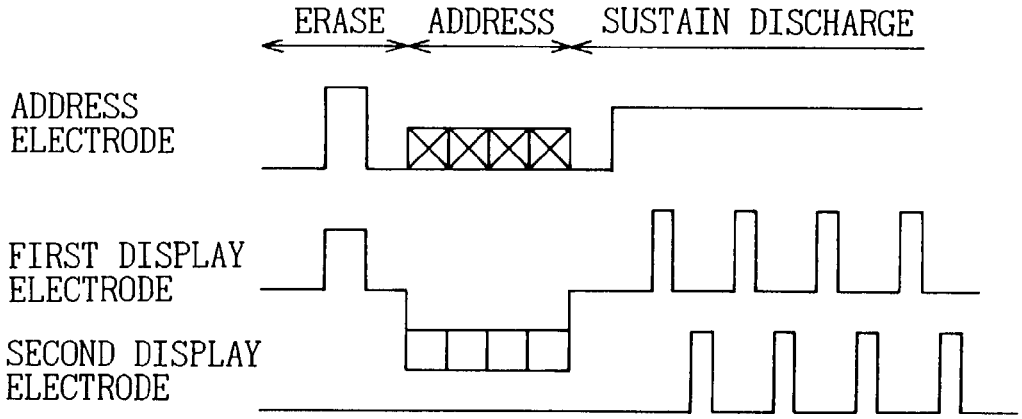
FIG. 13A and FIG. 13B are diagrams that show the drive waveforms in the second embodiment.
Figure 13B:
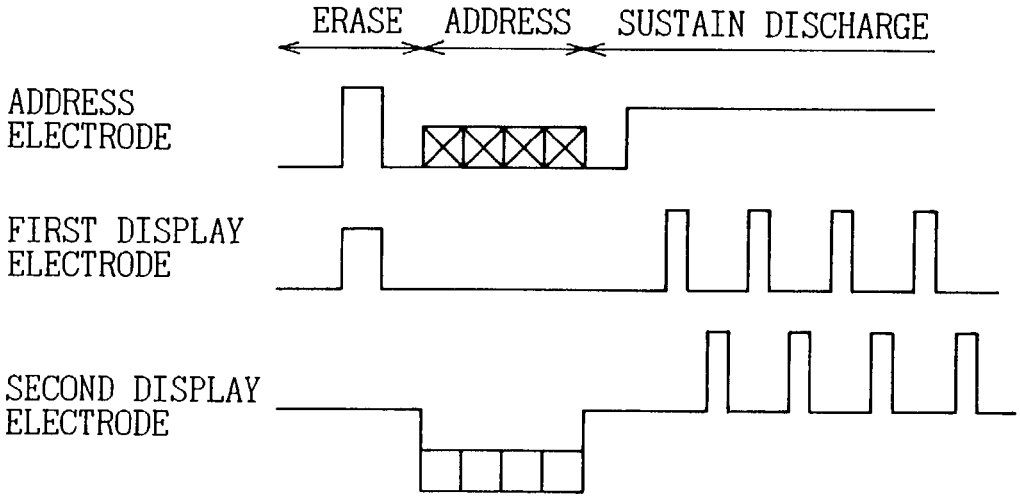

FIG. 13A and FIG. 13B are diagrams that show the drive waveforms in the second embodiment. In the odd field, as shown in FIG. 13A, the first display electrodes Z1, Z3, . . . are used as the scan electrodes and the second display electrodes Z2, Z4, . . . are used as the sustain electrodes, and in the even field, as shown in FIG. 13B, the first display electrodes Z1, Z3, . . . are used as the sustain electrodes and the second display electrodes Z2, Z4, . . . are used as the scan electrodes. In the odd field, therefore, the first scan electrode drive circuit 23-1 applies the erase pulse in the erase period, the scan pulse in the address period, and the sustain discharge pulse in the sustain discharge period to the first display electrodes Z1, Z3, . . . . The second scan electrode drive circuit 23-2 applies 0 V in the erase period and the address period, and the sustain discharge pulse in the sustain discharge period to the second display electrodes Z2, Z4, . . . . In the even field, the first scan electrode drive circuit 23-1 applies 0 V in the erase period and the address period, and the sustain discharge pulse in the sustain discharge period to the first display electrodes Z1, Z3, . . . . The second scan electrode drive circuit 23-2 applies the erase pulse in the erase period, the scan pulse in the address period, and the sustain discharge pulse in the sustain discharge period to the second display electrodes Z2, Z4, . . .

FIG. 14 is a diagram that shows the display lines in the second embodiment. In the odd field, as shown schematically, the data of the odd-numbered display lines is displayed in two display lines, but the first display data is displayed only in a display line and no data is displayed in the last display line. In the even field, the data of the even-numbered display lines is displayed in two display lines.

According to the present invention, as described above, a display of high-luminance and high-quality can be obtained when a dot matrix type PDP is driven by the interlacing method.

We claim:

1. A plasma display apparatus, comprising a dot matrix type AC plasma display panel, which comprises display electrodes that are arranged adjacently, extend in the same direction, and execute a light-emitting action in each display cell, and a rib that separates individual display cells, and in which a display line is formed between every pair of neighboring display electrodes, and a display electrode drive circuit that drives the display electrodes, and operating in the interlacing method, wherein the display electrodes are composed of first display electrodes and second display electrodes, and the display electrode drive circuit applies a scan pulse to either the first display electrodes or the second display electrodes during addressing in the odd field, and applies a scan pulse to the others of the first display electrodes or the second display electrodes during addressing in the even field, wherein the data in a line of the interlaced signal is displayed simultaneously in two neighboring lines and all lines are simultaneously displayed in each of odd and even fields.

2. A plasma display apparatus, as set forth in claim 1, wherein the display electrode drive circuit comprises a scan electrode drive circuit that puts out a scan pulse sequentially during addressing and at the same time puts out a sustain discharge pulse during sustain discharge, a sustain electrode drive circuit that puts out a sustain discharge pulse during sustain discharge, a scan electrode switch that switches the scan electrode drive circuit so as to alternately connect to the first and the second display electrodes, and a sustain electrode switch that switches the sustain electrode drive circuit so as to alternately connect to the first and the second display electrodes, to which the scan electrode drive circuit is not connected.

3. A plasma display apparatus, as set forth in claim 1, wherein the display electrode drive circuit comprises a first scan electrode drive circuit that puts out a scan pulse sequentially during addressing and at the same time puts out a sustain discharge pulse during sustain discharge and a second scan electrode drive circuit that puts out a scan pulse sequentially during addressing and at the same time puts out a sustain discharge pulse during sustain discharge, and the first scan electrode drive circuit drives the first display electrodes and the second sustain electrode drive circuit drives the second display electrodes.

4. A plasma display apparatus, as set forth in claim 1, wherein the plasma display panel comprises address electrodes that extend in the direction perpendicular to that of the display electrodes and, while the display electrode drive circuit is applying a scan pulse, the display cells on both the sides of the display electrode, to which the scan pulse is applied, are addressed simultaneously with the same signal.

* * * * *